United States Patent [19]

Möll

[11] 4,350,024

[45] Sep. 21, 1982

[54] HEATING SYSTEM

[75] Inventor: Thorleif Möll, Fjärås, Sweden

[73] Assignee: Cinderella AB, Sweden

[21] Appl. No.: 197,329

[22] Filed: Oct. 15, 1980

[30] Foreign Application Priority Data

Oct. 15, 1979 [NO] Norway ..... 793312

[51] Int. Cl.[3] ..... F25B 27/02

[52] U.S. Cl. ..... 62/238.6; 237/2 B

[58] Field of Search ..... 62/238.6; 165/169, 104 S, 165/DIG. 12; 237/2 B, 19

[56] References Cited

U.S. PATENT DOCUMENTS

| | | | |
|---|---|---|---|
| 1,874,803 | 8/1932 | Reed | 62/238.6 |
| 3,916,638 | 11/1975 | Schmidt | 62/238.6 |
| 3,926,008 | 12/1975 | Webber | 62/238.6 |
| 4,148,355 | 4/1979 | Gehring | 62/238.6 |
| 4,226,606 | 10/1980 | Yaeger | 62/238.6 |
| 4,240,267 | 12/1980 | Shaw | 62/238.6 |

*Primary Examiner*—Lloyd L. King

*Attorney, Agent, or Firm*—Lowe, King, Price & Becker

[57] ABSTRACT

The invention relates to a heating system comprising a compressor for supplying a heated medium, preferably a heated gas, for example Freon gas, to two pipe coils each adapted to heat one fluid by means of the medium, the fluid flowing through the pipe coils and from the pipe coils to the compressor. One fluid is stored within a tank through which one of the pipe coils extends. The other fluid is supplied by a regulator to a heat exchanger wrapped around the tank and second pipe coil. The compressor and regulator as well as flow of medium to the two pipe coils are controlled as a function of the temperatures of the two fluids.

9 Claims, 2 Drawing Figures

HEATING SYSTEM

The present invention relates to a heating system comprising a compressor for feeding a heated medium, preferably a heated gas, for example Freon gas, to two pipe coils each being adapted to heat one fluid by means of the medium, the fluid flowing through the coils and being returned from the coils to the compressor.

In a heating system of said kind it is previously known to utilize the earth's heat or the heat of water in deep wells. Thereby the heating system is used for heating water of a water heater and for heating the water of radiators.

Norwegian patent application No. 762183 describes a heating system in which the earth's heat is utilized and the heating medium consists of Freon gas. A drawback of this system is that the hot gas has to flow through a water heater before it can be conducted to a heat exchanger for heating the radiator water. This causes the temperature of the gas to be substantially reduced before the gas reaches the heat exchanger for heating the radiator water, if very much water is drained from the water heater.

The object of the invention is to provide an improved heating system of the kind described.

In order to comply with this object the heating system according to the invention is characterized in that the pipe coils are connected in parallel to the compressor and that the system comprises a device for controlling the relationship between the flow of the medium through one of said coils and the flow of the medium through the other of said coils.

As described above it is preferred that the heating system is designed so that one of the pipe coils extends through a water heater and that the other pipe coil extends through a heat exchanger for heating water of radiators.

Preferably the control device is connected by a sensor which is adapted to measure the temperature of the fluids heated by means of the medium, said fluids being constituted by the hot water of the water heater and the hot water for radiators.

Thereby it is suitable that the control device automatically distributes the hot gas between the pipe coils with regard to the condensation effect in the pipe coils and the capacity demand so that the gas supply to the pipe coils is conducted in such a way that the gas is completely condensed in the pipe coils.

An embodiment of the invention is described in the following with reference to the accompanying drawing.

Figure 2:
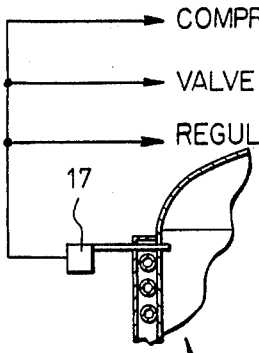
FIG. 2 shows a detail of the system according to FIG. 1 on an enlarged scale.
Figure 1:
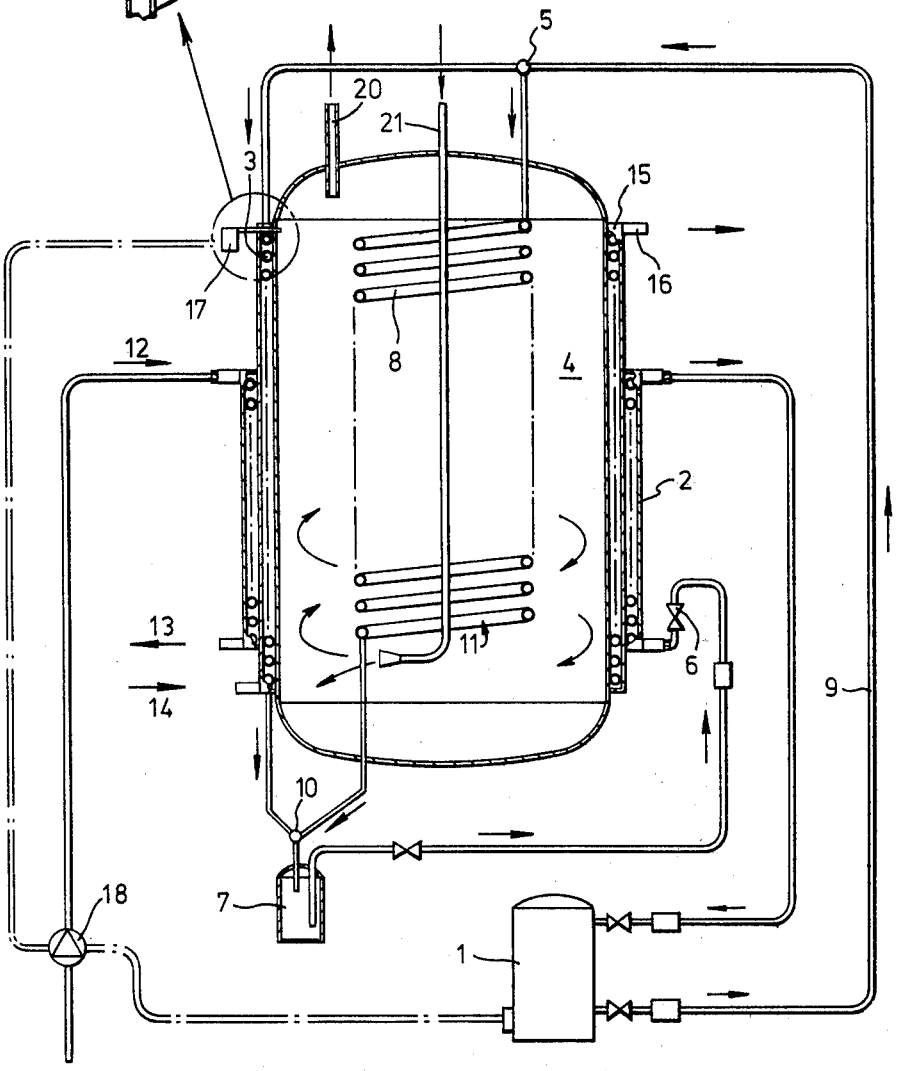
FIG. 1 is a schematical view of a heating system according to the invention.

A compressor 1 feeds hot Freon gas through a pressure conduit 9 to a control valve 5. From the control valve 5 a portion of the gas is directed into a pipe coil 8 positioned in a water heater 4. The gas is condensed in the pipe coil by the fact that the gas is cooled by the water of the water heater and leaves the lower end 11 of the pipe coil in a condensed state. The condensed gas is fed to a receiver 7 through a distributor valve 10. Another portion of the hot Freon gas is directed from the control valve 5 to a pipe coil 3 which is positioned in a jacket shaped heat exchanger 15 outside the water heater 4. Water which shall be heated by the Freon gas in order to heat radiators flows through the heat exchanger 15, and the Freon gas is cooled by this water to a condensed state. The condensed Freon gas is directed from the lower end of the pipe coil to the receiver 7 through the distributor valve 10. From the receiver 7 there is fed condensed, liquid state Freon, through an expansion valve 6 to a pipe coil in a evaporator 2 which as a jacket is positioned outside the jacket shaped heat exchanger 15. An insulating material is positioned between the heat exchanger 15 and the evaporator 2. The liquid state Freon will be evaporated in the evaporator 2 partly because of the fact that is subjected to a pressure reduction when passing the expansion valve 6 and partly by being heated in the evaporator 2 by the water circulating around the pipe coil in the evaporator. The water is supplied to the upper end of the evaporator, as shown by means of the arrow 12 in FIG. 1, and escapes from the lower end of the evaporator, as shown by means of the arrow 13 in FIG. 1. The water passing through the evaporator can be constituted by water which is heated by means of the earth heat or by means of the water of a deep well.

The water to the radiators is supplied to the jacket shaped heat exchanger 15 through a pipe 14 and escapes from the heat exchanger 15 through a pipe 16 at the upper portion of the heat exchanger.

A sensor 17 extends into the upper end of the heat exchanger 15 and into the upper end of the water heater 4 in order to sense the temperature of the radiator water as well as of the hot water in the water heater. The valve 5 is controlled by the sensor in order to control the amount of hot Freon gas flowing to the pipe coil 8 in the water heater 4 and to the pipe coil 3 in the heat exchanger 15. Thereby, the temperature of the hot water of the water heater and the hot water for the radiators is controlled. The sensor 17 is connected also with the compressor 1 and with a regulator 18 for controlling the feeding of water to the evaporator 2. Thus, the compressor 1 and the regulator 18 functions in dependence of the temperature of the hot water of the water heater and the hot water for the radiators, respectively.

In a system according to the invention it is possible to provide the consumption water with a temperature of 58°–65° C. and the radiator water with a temperature of 50°–56° C. By means of the described distribution of the gas supply to the hot water heater and the heat exchanger for the radiators there is provided a more rapid heating of the consumption water.

I claim:

1. A heating system for heating first and second fluids, comprising:

compressor means for heating a heat exchange medium, such as Freon, to a gas;

means for supplying the medium from said compressor means to first and second, parallel pipe coils;

valve means for controlling amounts of said medium supplied to said first and second pipe coils;

a tank for storing said first fluid to be heated;

said first pipe coil in said tank being submerged in said first fluid;

said second pipe coil external to and in thermal contact with said tank;

means for supplying said second fluid into thermal contact with said second pipe coil;

evaporator means external to and in proximity with said second pipe coil;

means for supplying the medium, condensed in said first and second pipe coils, to said evaporator means for evaporation; and means for returning the evaporated medium to said compressor.

2. The system of claim 1, including:

means for sensing a temperature of said first and second fluids; and means responsive to said temperature sensing means for controlling an operating parameter of said heating system.

3. The system of claim 1, including an expansion valve upstream from the evaporator means.

4. The system of claim 1, including a receiver for receiving the condensed medium from said first and second pipe coils and a distributor valve for controlling flow of said condensed medium.

5. The system of claim 1, wherein said second pipe coil is disposed in a heat exchange jacket wrapped around said tank, said second fluid being supplied to said heat exchange jacket.

6. The system of claim 5, wherein said evaporator means is wrapped around said heat exchanger jacket.

7. The system of claim 2, wherein said temperature responsive means includes means for controlling said compressor means.

8. The system of claim 2, wherein said temperature responsive means includes means for controlling said regulator means.

9. The system of claim 2, wherein said temperature responsive means includes means for controlling said valve means.

* * * * *